United States Patent [19]

Curtis

[11] Patent Number: 5,007,553

[45] Date of Patent: Apr. 16, 1991

[54] CONTAINER FOR A PAINT BRUSH

[76] Inventor: Lee J. Curtis, 74 Patshull Road, London NW5 2LD, England

[21] Appl. No.: 461,052

[22] Filed: Jan. 4, 1990

[30] Foreign Application Priority Data

Jan. 13, 1989 [GB] United Kingdom ..... 8900773

[51] Int. Cl.[5] ..... A45D 44/18; B65D 25/00; A47L 13/56

[52] U.S. Cl. ..... 220/90; 206/15.3; 15/257.05

[58] Field of Search ..... 220/90; 206/15.2, 15.3; 15/257.05

[56] References Cited

U.S. PATENT DOCUMENTS

| | | | |
|---|---|---|---|
| 2,180,581 | 11/1939 | Eisenberg | 15/257.05 |
| 2,742,180 | 4/1956 | Miljevich | 220/90 |
| 2,789,297 | 4/1957 | Barr | 220/90 |
| 2,827,648 | 3/1958 | Geisz | 220/90 |
| 2,988,767 | 6/1961 | Tretwold et al. | 220/90 |
| 3,028,041 | 4/1962 | Rinchak | 220/90 |
| 3,291,295 | 12/1966 | Caligiuri | 206/15.3 |
| 3,292,815 | 12/1966 | Smith et al. | 15/257.05 |
| 3,641,615 | 2/1972 | Peasley | 220/90 |
| 4,533,044 | 8/1985 | Ban | 206/15.3 |
| 4,721,225 | 1/1988 | Sobel | 220/90 |
| 4,771,501 | 9/1988 | Leiter | 15/257.05 |
| 4,865,282 | 9/1989 | Yonkman et al. | 220/90 |

FOREIGN PATENT DOCUMENTS

| | | | |
|---|---|---|---|
| 112562 | 2/1941 | Australia | 220/90 |
| 1077881 | 5/1954 | France | 220/90 |
| 2299167 | 10/1974 | France | 220/90 |
| 296948 | 9/1928 | United Kingdom | 220/90 |
| 1286366 | 8/1972 | United Kingdom | 206/15.3 |
| 2188026 | 9/1987 | United Kingdom | 220/90 |

*Primary Examiner*—William I. Price
*Attorney, Agent, or Firm*—Joseph S. Iandiorio

[57] ABSTRACT

A container for a paint brush, which container comprises a body and a lid, the body having a base and a walled portion which upstands from the base, the lid having an aperture through which a handle of the paint brush passes and slits which extend from the aperture and which enables parts of the lid defining the aperture to grip the handle of the paint brush, and the walled portion of the body having an inwardly projecting integrally formed shelf portion on which to rest the paint brush, and integrally formed ribs which extend parallel to the base and which are for wiping excess paint from the paint brush.

7 Claims, 8 Drawing Sheets

CONTAINER FOR A PAINT BRUSH

This invention relates to a container for a paint brush.

Persons decorating always seem to need a container for a paint brush. More specifically, persons decorating the inside or outside of a building invariably have to stop one or more times during the course of the decorating and it is then necessary to find a container to clean the paint brush to stop it going hard, or more usually to find a container in which to submerse the paint brush in an appropriate liquid to stop the paint brush going hard. Old paint pots and jam jars are most usually used but often a convenient empty paint pot or jam jar is not available. A custom made container is known but this is expensive to produce and it occupies an unnecessarily large amount of space. Thus, the known custom made container is difficult to produce and market on a commercial scale since production and packaging costs are high and, furthermore, the container may occupy too much space at the point of sale, for example on shelves in shops.

It is an aim of the present invention to reduce the above mentioned problems by providing a container which is able to be commercially produced and packaged, whilst retaining its usefulness.

Accordingly, this invention provides a container for a paint brush, which container comprises a body and a lid, the body having a base and a walled portion which upstands from the base, the lid having an aperture through which a handle of the paint brush passes and slits which extend from the aperture and which enable parts of the lid defining the aperture to grip the handle of the paint brush adjacent the aperture whereby, when the lid is on the body, the handle of the paint brush can extend beyond the lid and a brush part of the paint brush can be suspended in the body above the base of the body, the walled portion of the body having an inwardly projecting integrally formed shelf on which to rest the paint brush inside the body when the lid is not on the body, and the walled portion of the body also having integrally formed ribs which extend parallel to the base and which are for facilitating wiping excess paint from the paint brush.

The container may be one in which the ribs are positioned above the shelf.

Preferably, the container is one in which the walled portion is circular in plan view, in which the shelf forms part of a disc in plan view, and in which the ribs are curved ribs which follow the curve of the walled portion.

The lid of the container serves the dual purpose of closing the body and thus helping to inhibit evaporation of paint cleaning liquids inside the body, and also of supporting the paint brush such that the brush part of the paint brush is suspended in the body above the base of the body. Thus the suspended paint brush does not contact any removed paint that may have settled on the base of the body of the container. Because the handle is able to extend through the lid, the lid does not have to extend to a relatively large height as would be the case if the lid had to completely enclose the handle of the paint brush. Thus the lid can easily be made substantially flat.

The lid may be any type of lid so that it may fit to the container by just sitting on top of the container, or the lid may be a push fit, a screw fit or a twist fit on top of the body of the container. The lid may fit inside or outside the body of the container. The lid will usually be of a complementary size and shape to that of the desired size and shape of the body of the container.

The container of the present invention can be used in two different ways. Firstly, with the lid in position, the container is able to store and clean the paint brush after use, or for a long break during use. Secondly, with the lid removed, the body of the container is still available for storing and cleaning the brush, for example during actual painting.

The container may include paint removing means which is separately formed from the body and which is for facilitating removing paint deposited in the body.

The paint removing means may comprise a tray having at least one aperture, the aperture enabling the tray to sink to the bottom of the body when the body contains a paint removing liquid. Alternatively, the paint removing means may comprise a wire pad, or a pad which is made of a plastics material and which has at least one aperture for enabling the pad to sink to the bottom of the body when the body contains a paint removing liquid.

The body of the container is such that the walled portion may be square, rectangular, circular, triangular or any other desired and suitable shape in plan.

The body and the lid may be made of any desired and suitable material. A plastics material is presently preferred. The plastics material will usually be such as to form thin walls so that the body and the lid are flexible. The body and the lid may be blow moulded, injection moulded, vacuum formed or produced in any other desired manner. Usually the body and the lid will each be formed as one separate piece.

The container may include the paint brush. The paint brush may be of any desired size and type.

Because the handle of the brush extends above the lid of the container, it will be apparent that the container can be produced in a compact manner which saves on the cost of raw materials and also saves on packaging space. The container can be produced to occupy only a relatively small amount of space at the point of sale, for example on shelves in shops. Thus commercial buyers may be more inclined to stock the containers of the present invention rather than containers which are larger due to the fact that they totally enclose the paint brush.

During use, the container may contain any desired and appropriate paint cleaning liquid such for example as water for water-based paints, and turpentine or white spirit for oil-based paints.

Embodiments of the invention will now be described solely by way of example and with reference to the accompanying drawings in which.

Figure 1:
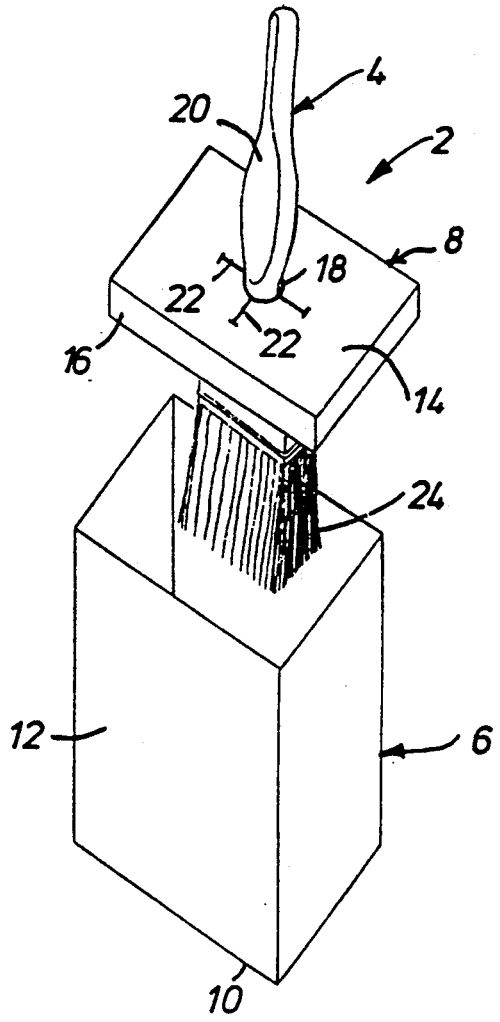
FIG. 1 is a perspective view in an open condition of a container with a paint brush.
Figure 2:
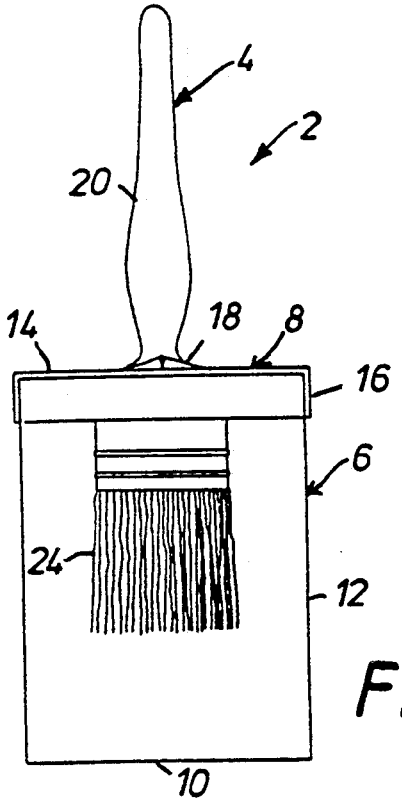
FIG. 2 is a cross section through the container shown in FIG. 1.

Referring to FIGS. 1 and 2, there is shown a container 2 for a paint brush 4. The container 2 comprises a body 6 and a lid 8.

The body 6 has a base 10 and a walled portion 12 which upstands from the base 10.

The lid 8 has a top portion 14 and side walls 16 as shown in FIG. 2. The side walls 16 fit over the top of the walled portion 12 of the body 6. Thus the lid 8 forms a closure and partial seal for the body 6.

The lid 8 has an aperture 18 through which a handle 20 of the paint brush 4 passes. The lid 8 also has gripper means in the form of slits 22. The slits 22 define a cross and they extend to the edge of the aperture 18 as most clearly shown in FIG. 1. The slits 22 enable the top portion 14 of the lid 8 to grip the handle 20 adjacent the aperture 18. The slits 22 also enable the aperture 18 to expand and contract as desired for different sizes and shapes of handle 20.

As can be seen from FIGS. 1 and 2, the slits 22 enable the handle 20 to be gripped such that the paint brush 4 extends upwardly beyond the lid 8 with a brush part 24 of the paint brush 4 suspended in the body 6 but above the base 10 of the body 6. Thus any paint sediment or dirt collecting inside the body 6 on the base 10 will not contaminate the brush part 24 since the brush part 24 will be spaced apart from the base 10 as shown in FIG. 2. Because the handle 20 sticks up beyond the lid 8, the body 6 and/or the lid 8 do not have to be sufficiently large to include the handle 20 so that the overall size of the container 2 can be kept to a minimum.

Figure 3:
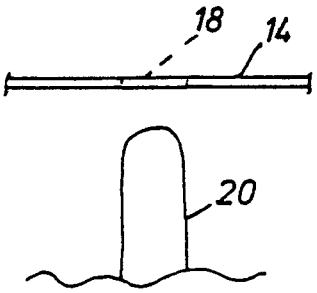
FIGS. 3, 4 and 5 illustrate the action of the gripper means shown in FIGS. 1 and 2.
Figure 4:
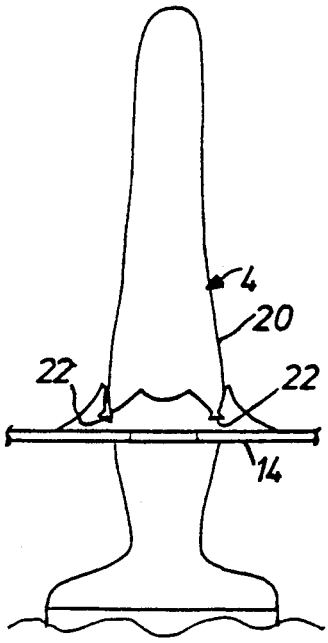
Figure 5:
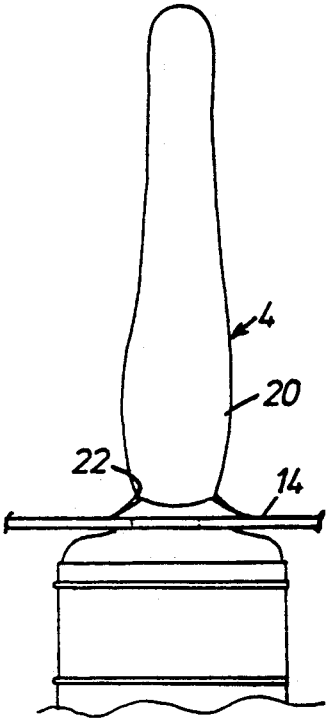

Referring now to FIGS. 3, 4 and 5 there is shown part of the top portion 14 of the lid 8. The expanding action of the aperture 18 and the gripping action of the slits 22 are illustrated.

Figure 6:
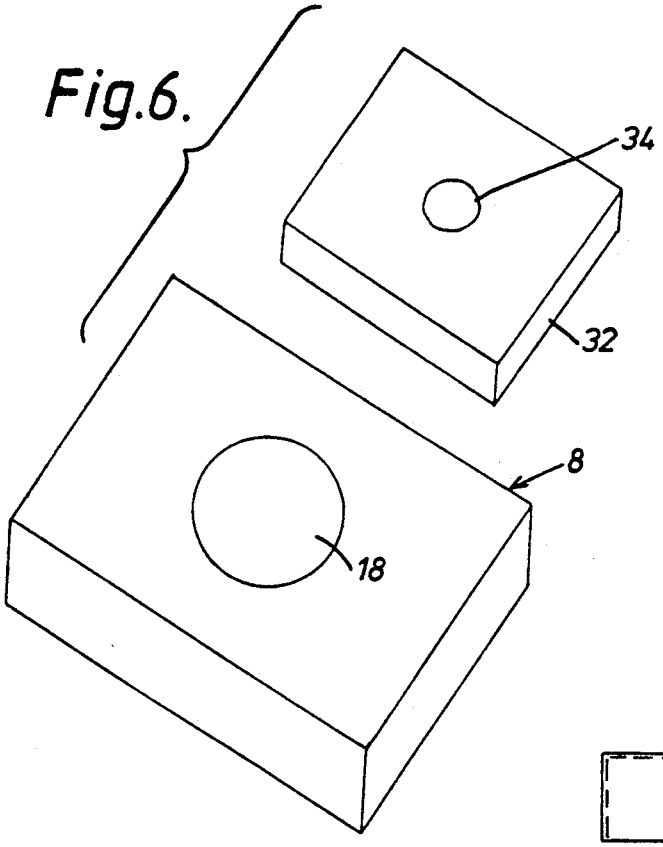
FIGS. 6 and 7 show alternative gripper means.
Figure 7:
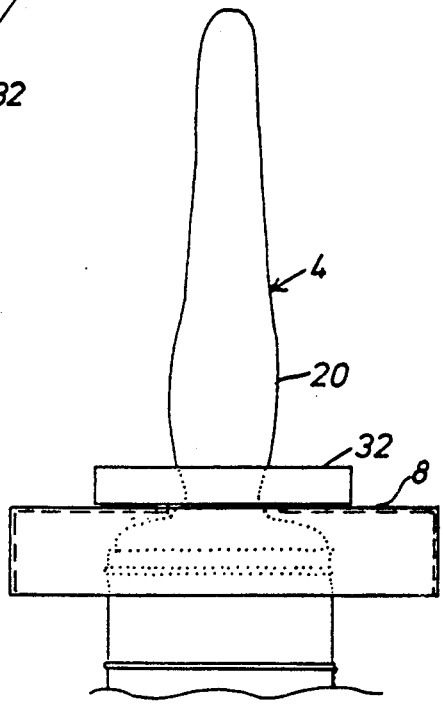

FIGS. 6 and 7 show further gripper means in the form of an insert 32. The insert 32 can be placed as shown on top of the lid 8. The insert 32 can be made of a foam plastics material or foam rubber so that, by virtue of the nature of the material from which the insert 32 is formed, the aperture 34 in the insert 32 can expand and contract to receive and grip the handle 20 of the paint brush 4.

Figure 8:
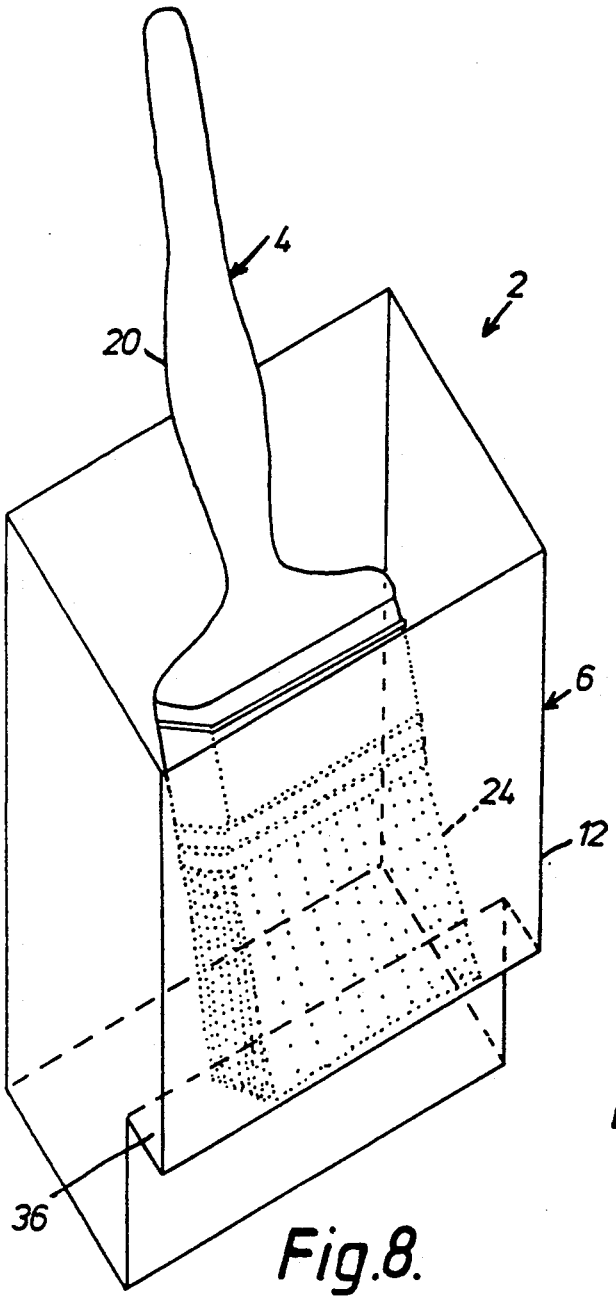
FIGS. 8 to 15 show alternative shapes for containers having integrally formed shelf means on which to rest the paint brush.
Figure 9:
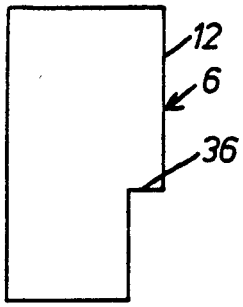
Figure 10:
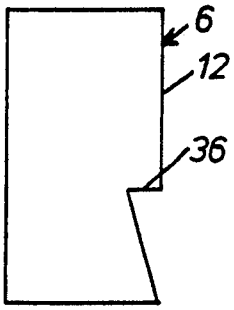
Figure 11:
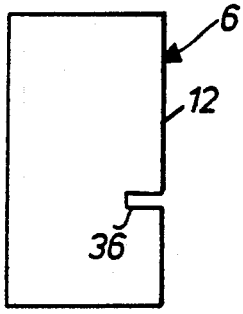

FIGS. 8 and 9 show the shape of a body 6 formed with shelf means 36. The shelf means 36 is formed as an integral part of the walled portion 12. FIGS. 10 and 11 are side views similar to FIG. 9 but they show alternative ways of forming the shelf means 36 in the walled portion 12.

Figure 12:
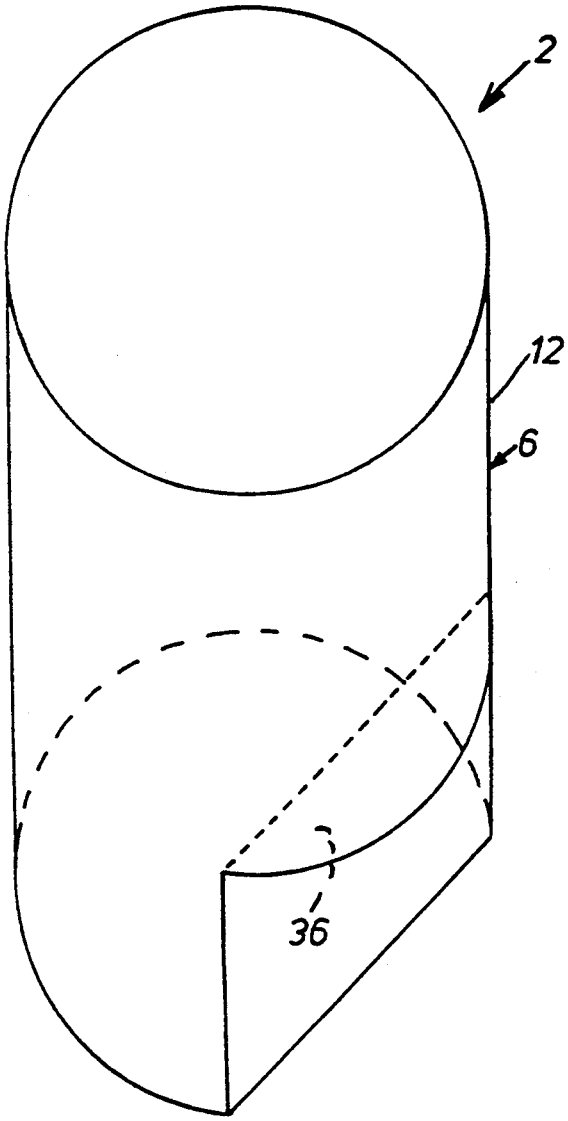
Figure 13:
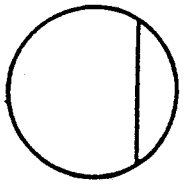

FIG. 12 is a perspective view of a container 2 but which has a round walled portion 12 instead of a rectilinear walled portion 12 as shown in FIG. 8. FIG. 13 is a plan view of the container 2 as shown in FIG. 12. In both FIGS. 8 and 12, the lid has been omitted for ease of illustration. The lid will however be shaped to fit on to the body 6 as shown in FIGS. 8 and 12.

Figure 14:
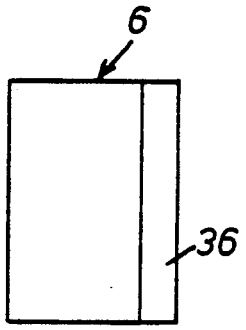
Figure 15:
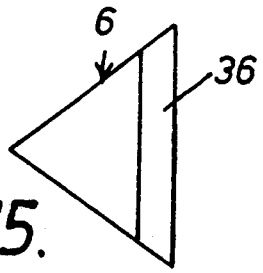

FIGS. 14 and 15 are plan views of alternative types of body 6 so that it will be seen from FIG. 14 that the body 6 is rectangular, and it will be seen from FIG. 15 that the body 6 is triangular in plan. The body 6 in both FIGS. 14 and 15 is provided with the shelf means 36.

Figure 16:
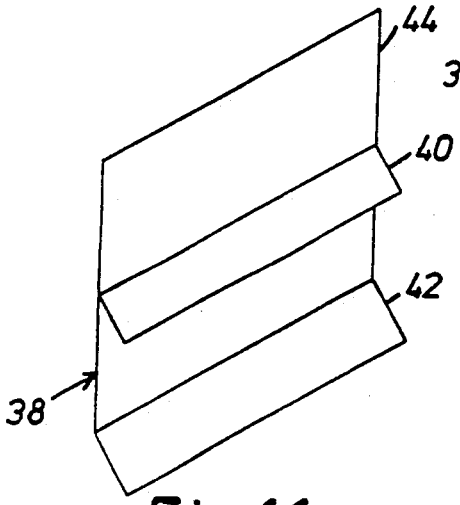
FIGS. 16 and 17 illustrate shelf means in the form of an insert.
Figure 17:
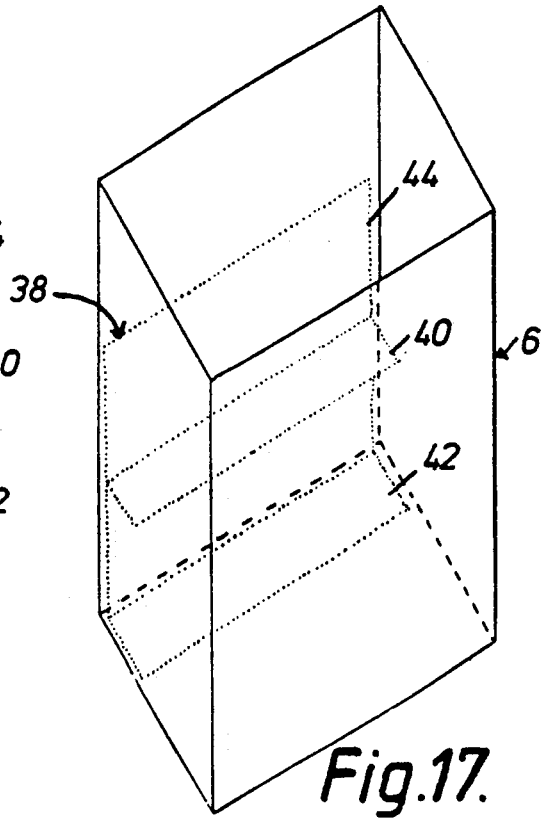

FIGS. 16 and 17 show shelf means in the form of an insert 38 which is separately formed from the body 6 of the container 2 and which is inserted into the body 6 as shown in FIG. 17. The insert 38 has a shelf portion 40 and a foot portion 42. The foot portion 42 keeps a back portion 44 vertical during use of the insert 38 in the body 6 as shown in FIG. 17.

Figure 18:
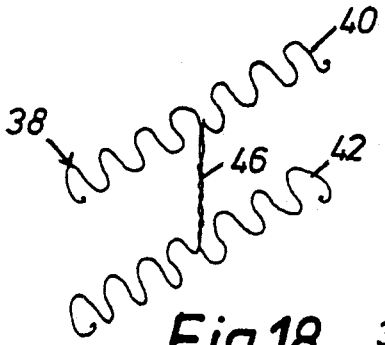
FIGS. 18 and 19 show further shelf means in the form of an insert.
Figure 19:
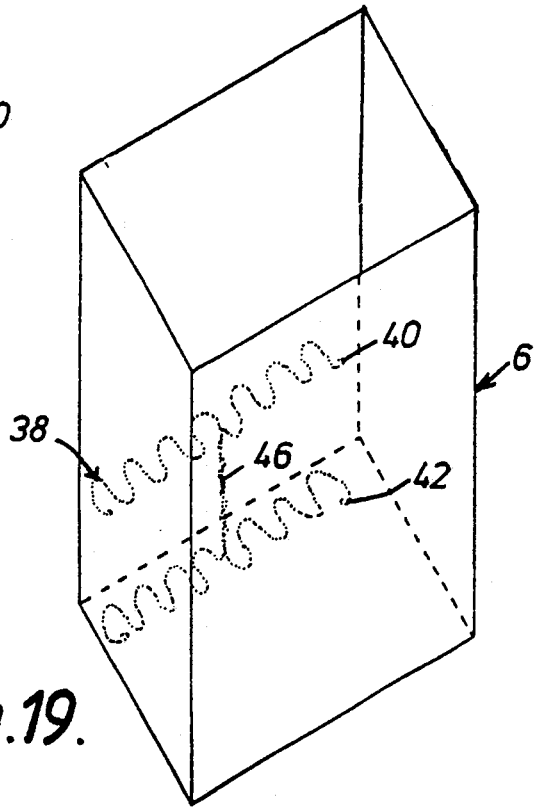

FIGS. 18 and 19 show an alternative insert 38 which can be made of bent wire or a bent plastics material. The insert 38 shown in FIGS. 18 and 19 still has the shelf portion 40 and the foot portion 42, but the back portion 44 as shown in FIG. 16 has been replaced by a rod portion 46 which can be formed from the same material as that used to form the shelf portion 40 and the foot portion 42.

Figure 20:
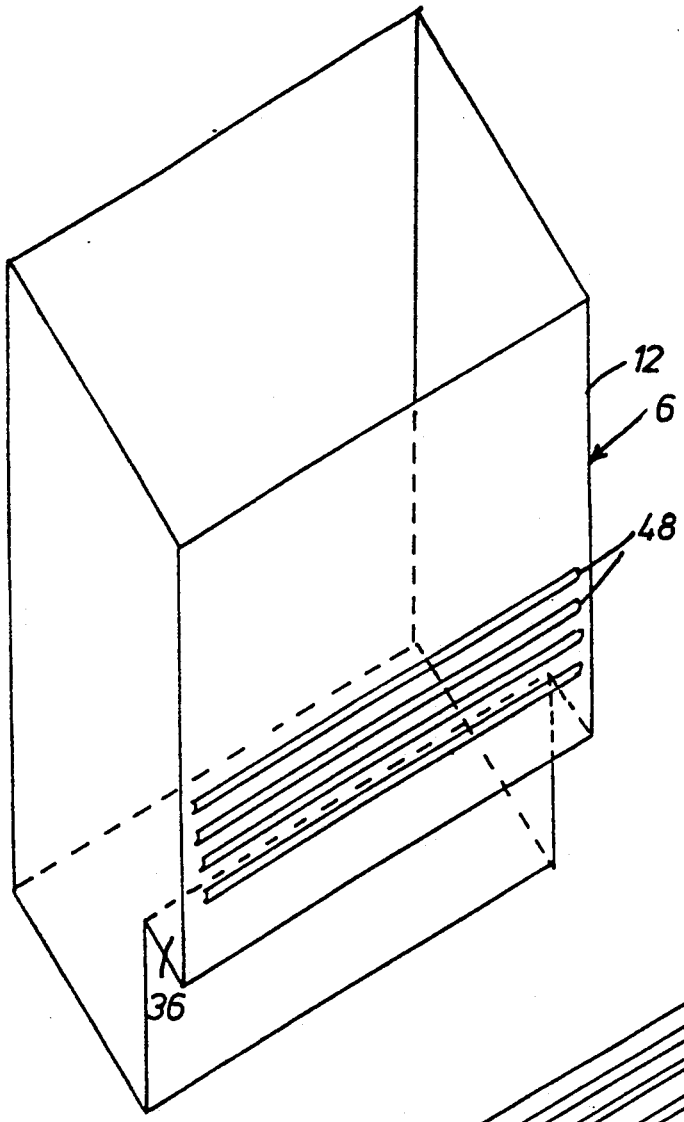
FIG. 20 shows a container having wiping means formed as an integral part of the container.

FIG. 20 illustrates the body 6 formed with wiping means in the form of ribs 48 for wiping excess paint from the paint brush. The ribs 48 as shown in FIG. 20 are integrally formed as part of the walled portion 12 of the body 6 of the container 2.

Figure 21:
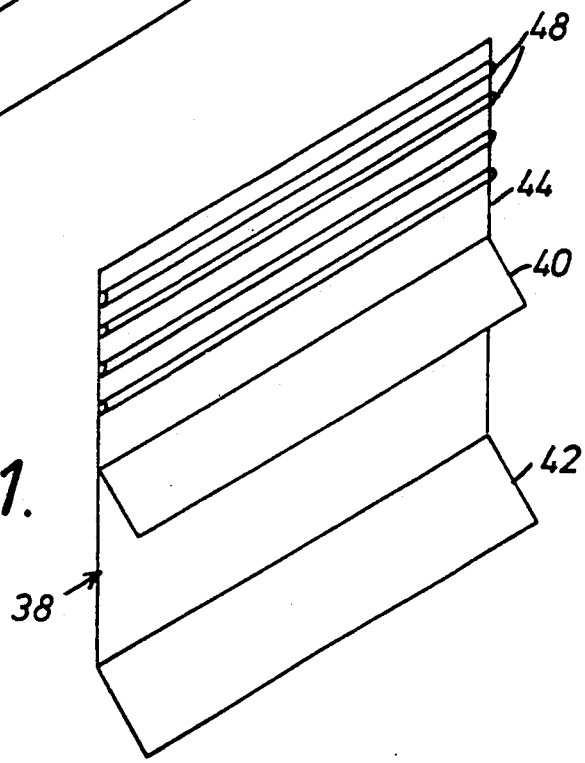
FIG. 21 shows an insert having both shelf means and wiping means.

In FIG. 21, there is shown an insert 38 which is like the insert 38 shown in FIG. 16 but which is also provided with ribs 48. Thus the insert 38 shown in FIG. 21 has the wiping means in the form of the ribs 48 and it also has the shelf means in the form of the shelf portion 40.

Figure 22:
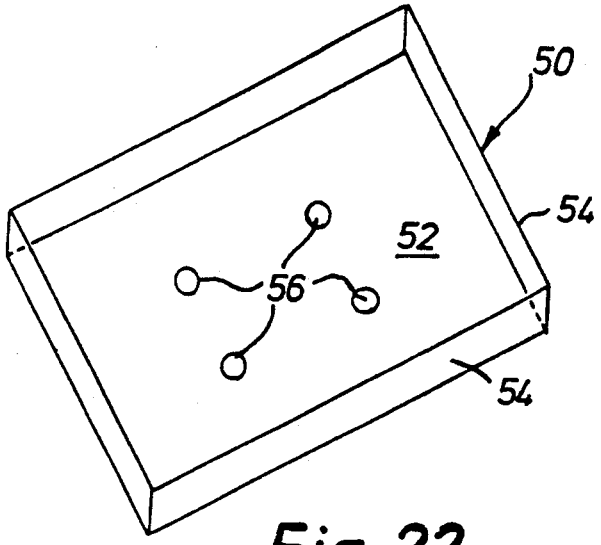
FIG. 22 shows paint removing means.

FIG. 22 shows paint removing means in the form of a tray 50. The tray 50 has a base 52 and upstanding side walls 54. The base 52 has four apertures 56 which ensure that the tray 50 sinks to the bottom of the body 6 of the container 2 when the body 6 contains a paint removing liquid.

Figure 23:
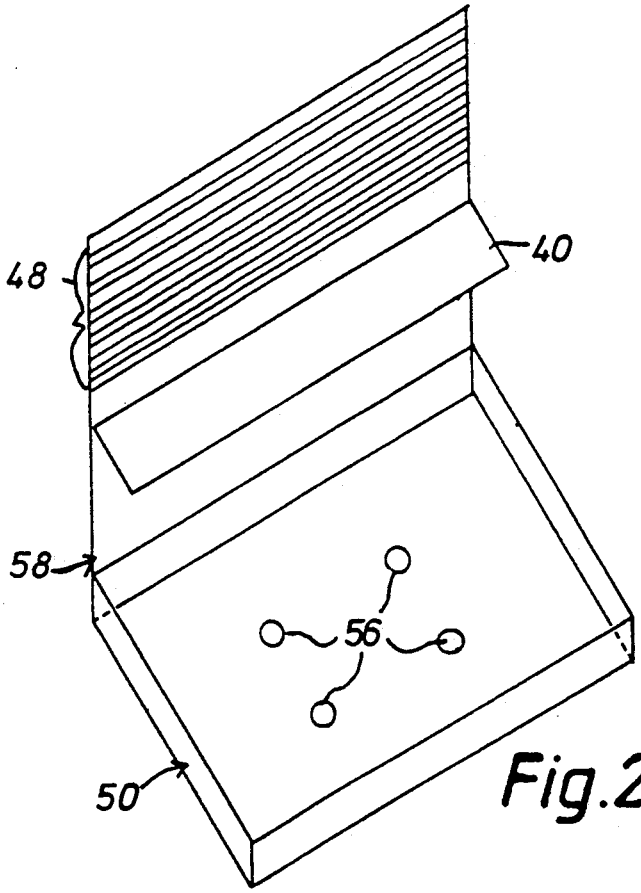
FIG. 23 shows an insert having a shelf, wiping means and paint removing means.

FIG. 23 shows an insert 58 which is a combined insert and which includes the tray 50, the shelf portion 40 and the ribs 48. Thus the insert 58 shown in FIG. 23 has shelf means, paint wiping means and paint removing means. When the insert 50 shown in FIG. 22 or the insert 58 shown in FIG. 23 are removed, any paint sediment and other dirt can collect in the base 52 of the tray 50.

It is to be appreciated that the embodiments of the invention described above with reference to the accompanying drawings have been given by way of example only and that modifications may be effected. Thus, for example, different types of shelf means may be employed other than the illustrated shelf means 36. Similarly, different types of wiping means than the ribs 48 may be employed, and different types of paint removing means can be employed other than the tray 50. The tray 50 may be replaced by an apertured piece of sponge material or by a wire wool pad. The container 2 can be made from any desired and appropriate materials and it can be made in any desired and appropriate sizes and shapes. The insert 32 shown in FIGS. 6 and 7 may alternatively be fixed inside the lid 8 instead of on top of the lid 8.

What is claimed is:

1. A container for a paint brush, which container comprises a body and a lid, the body having a base and a walled portion which upstands from the base, the lid having an aperture through which a handle of the paint brush passes and slits which extend from the aperture and which enable parts of the lid defining the aperture to grip the handle of the paint brush adjacent the aperture whereby, when the lid is on the body, the handle of the paint brush can extend beyond the lid and a brush part of the paint brush can be suspended in the body above the base of the body, the walled portion of the body having an inwardly projecting integrally formed shelf on which to rest the paint brush inside the body when the lid is not on the body, and the walled portion of the body also having integrally formed ribs which extend parallel to the base and which are for facilitating wiping excess paint from the paint brush.

2. A container according to claim 1 in which the ribs are positioned above the shelf.

3. A container according to claim 2 in which the walled portion is circular in plan view, in which the shelf forms part of a disc in plan view, and in which the ribs are curved ribs which follow the curve of the walled portion.

4. A container according to claim 2 and including paint removing means for facilitating removing paint deposited in the body, the paint removing means being separately formed from the body such that the paint removing means is a loose fit in the body on the base of the body, and the paint removing means being constructed such that it is able to sink to the base of the body when the body contains a paint removing liquid.

5. A container according to claim 4 in which the paint removing means is a tray having at least one aperture, the aperture enabling the tray to sink to the base of the body when the body contains the paint removing liquid.

6. A container according to claim 4 in which the paint removing means is a wire pad.

7. A container according to claim 4 in which the paint removing means is a pad which is made of a plastics material and which has at least one aperture for enabling the pad to sink to the base of the body when the body contains the paint removing liquid.

* * * * *